US011465875B2

(12) United States Patent
Lin

(10) Patent No.: US 11,465,875 B2
(45) Date of Patent: Oct. 11, 2022

(54) COIL FEEDING DEVICE AND GRAPHIC MACHINE THEREOF

(71) Applicant: Jingwei Systemtechnik Ltd., Ningbo (CN)

(72) Inventor: Lixue Lin, Ningbo (CN)

(73) Assignee: Jingwei Systemtechnik Ltd., Ningbo (CN)

( * ) Notice: Subject to any disclaimer, the term of this patent is extended or adjusted under 35 U.S.C. 154(b) by 510 days.

(21) Appl. No.: 16/683,199

(22) Filed: Nov. 13, 2019

(65) Prior Publication Data

US 2021/0107762 A1 Apr. 15, 2021

(30) Foreign Application Priority Data

Oct. 15, 2019 (CN) ..... 201910975703.9

(51) Int. Cl.

| | |
|---|---|
| ***B65H 75/08*** | (2006.01) |
| ***B65H 16/06*** | (2006.01) |
| ***B65H 19/12*** | (2006.01) |
| ***B65H 20/06*** | (2006.01) |

(52) U.S. Cl.

CPC ..... *B65H 75/08* (2013.01); *B65H 16/06* (2013.01); *B65H 19/126* (2013.01); *B65H 20/06* (2013.01); *B65H 2301/41344* (2013.01); *B65H 2405/42* (2013.01)

(58) Field of Classification Search

CPC ..... B65H 75/08; B65H 75/185; B65H 16/06; B65H 19/126; B65H 2301/41344; B65H 2405/42; B65H 20/06

See application file for complete search history.

(56) References Cited

U.S. PATENT DOCUMENTS

2005/0220534 A1* 10/2005 Ober ..... B65H 75/08 403/370

2019/0216270 A1* 7/2019 Osborne, Jr. ..... A47K 10/3643

* cited by examiner

*Primary Examiner* — William E Dondero

(57) ABSTRACT

A coil feeding device and a graphic machine thereof are provided. The coil feeding device includes a roller mechanism for carrying a coiled material, a base mechanism, and a compression rod mechanism. The roller mechanism includes a shaft penetrating through the shaft hole and a tension structure disposed on the shaft. The tension structure includes a first sleeve, a second sleeve and a tapered fixing member. When the first sleeve and the second sleeve are fixed to each other, the tapered fixing member holds the shaft to achieve mutual fixation of the coiled material and the shaft. By providing the second sleeve, the first sleeve and the tapered fixing member that cooperate with each other, the coiled material and the shaft are fastened to each other quickly, thereby improving production efficiency. Through the base mechanism, the coil feeding device is directly used on existing graphic machine for material processing.

17 Claims, 9 Drawing Sheets

COIL FEEDING DEVICE AND GRAPHIC MACHINE THEREOF

BACKGROUND OF THE INVENTION

Field of the Invention

The present invention relates to the technical field of graphic equipment, in particular to a coil feeding device and a graphic machine thereof.

Description of Related Art

With the rapid development of the printing industry, the demand for graphic materials such as packaging cartons, book covers, and albums is also booming. In order to adapt to mass production, a processing device that can realize automatic feeding and cutting of graphic materials appears on the market, which greatly reduce the labor of the enterprise and improve the efficiency of the production of graphic materials.

Graphic materials are common in both forms of sheet material and coiled material. The existing graphic processing device for processing of coiled material has a complicated structure for feeding the coiled material with cumbersome operation, thereby causing the processing efficiency of the coiled material to be low; the existing graphic processing device can only realize the automatic processing of the sheet material or the automatic processing of the coiled material separately, thereby causing low versatility.

SUMMARY OF THE INVENTION

In order to overcome the drawbacks of the prior art, it is an object of the present invention to provide a coil feeding device. The coil feeding device of the present invention can overcome the problem that the coil feeding device has a complicated structure, low processing efficiency, and low versatility.

To overcome the above problems, a coil feeding device is provided in one embodiment of the present invention. The coil feeding device includes a roller mechanism, a base mechanism and a compression rod mechanism. The roller mechanism is used to carry a coiled material having a shaft hole, wherein the roller mechanism includes a shaft penetrating through the shaft hole, and a tension structure is disposed on the shaft. The tension structure includes a first sleeve sleeved outside the shaft, a second sleeve, and a tapered fixing member. An outer wall of the second sleeve is abutted against an inner wall of the shaft hole. An outer wall of the first sleeve is connected to the second sleeve, and an inner wall of the first sleeve is connected to the tapered fixing member. When the first sleeve and the second sleeve are fixed to each other, the tapered fixing member holds the shaft to achieve mutual fixation of the coiled material and the shaft. The base mechanism is used to support the roller mechanism, wherein the base mechanism is detachably mounted on a graphic machine. The compression rod mechanism is used to drive a rotation of the roller mechanism, wherein the compression rod mechanism is used in concert with a conveyor belt of the graphic machine.

In one embodiment, the base mechanism further includes a base, two support frames, and a plurality of bearings. The two support frames are fixed to left and right sides of the base. Two bearings are disposed at an upper end of each of the support frames, and the shaft is placed on the plurality of bearings.

In one embodiment, the compression rod mechanism further includes a compression rod, two connection rods, and a tension spring. The compression rod is used to compress the coiled material against the conveyor belt. The two connection rods are respectively connected to both ends of the compression rod, and the compression rod is hinged to the base mechanism through the two connection rods. The tension spring, connected between the two connection rods, and used to tighten the two compression rods.

In one embodiment, the outer wall of the second sleeve further includes a tapered surface, and the tapered surface is used to abut against the inner wall of the shaft hole.

In one embodiment, the outer wall of the second sleeve is detachably connected with an annular tapered member.

In one embodiment, the roller mechanism further includes a damper member disposed at both ends of the shaft, and used to prevent the roller mechanism from freely rotating.

In one embodiment, the roller mechanism further includes a limiting structure for fixing the damper member to the base mechanism. The limiting structure includes a limiting member connected to the base mechanism. A half-waist groove is disposed on the limiting member, and a limiting surface that cooperates with the half-waist groove is disposed on the damper member.

In one embodiment, the limiting member has a first end hinged to the base mechanism and a second end provided with a groove, and a bead that cooperates with the groove is disposed in the base mechanism.

Compared with the prior art, the coil feeding device of the present invention includes the second sleeve, the first sleeve and the tapered fixing member that cooperate with each other, such that the coiled material and the shaft are fastened to each other quickly, thereby improving production efficiency. Through the base mechanism, the coil feeding device is directly used on existing graphic machine for material processing. By providing the detachable base mechanism, the coil feeding device may be used as a separate detachable device that may be directly used on the existing graphic machine for processing of sheet material. Therefore, in the case that the transformation cost of the graphic machine is low, both the processing of sheet material and the processing of coiled material may be realized on the same graphic machine, which has strong versatility and is helpful for market promotion.

To overcome the above problems, a graphic machine having a coil feeding device above is provided in another embodiment of the present invention. Compared with the prior art, the beneficial effects of the graphic machine of the present invention are the same as those of the coil feeding device described above, and further description is omitted herein.

In one embodiment, the graphic machine further includes a switch or sensor for switching an operating mode of the graphic machine, wherein a pin that cooperates with the switch or sensor is disposed on the base mechanism.

BRIEF DESCRIPTION OF THE DRAWINGS

Aspects of the present invention are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DESCRIPTION OF THE INVENTION

Figure 1:
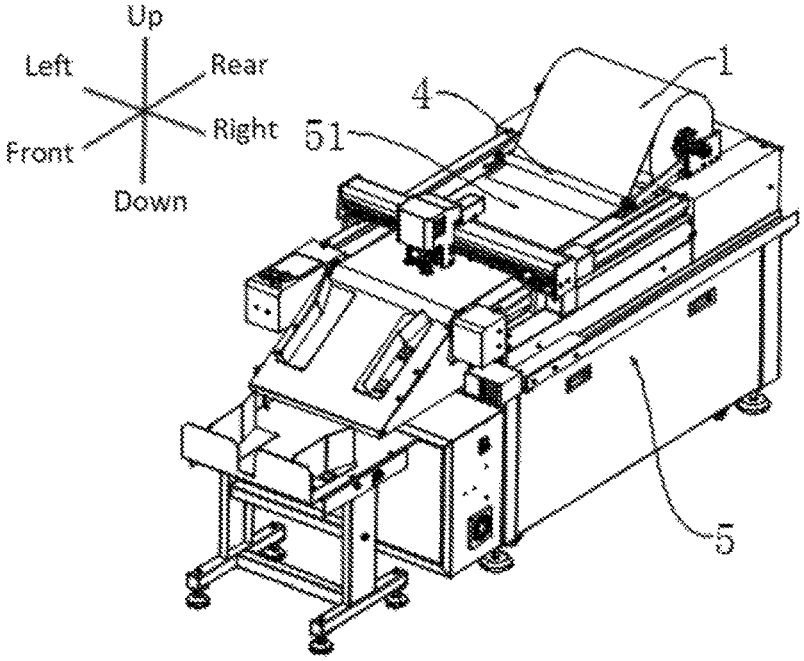
FIG. 1 is an overall structural view of a graphic machine according to an embodiment of the present invention.

The following invention provides many different embodiments, or examples, for implementing different features of the provided subject matter. Specific examples of components and arrangements are described below to simplify the present invention. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present invention may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
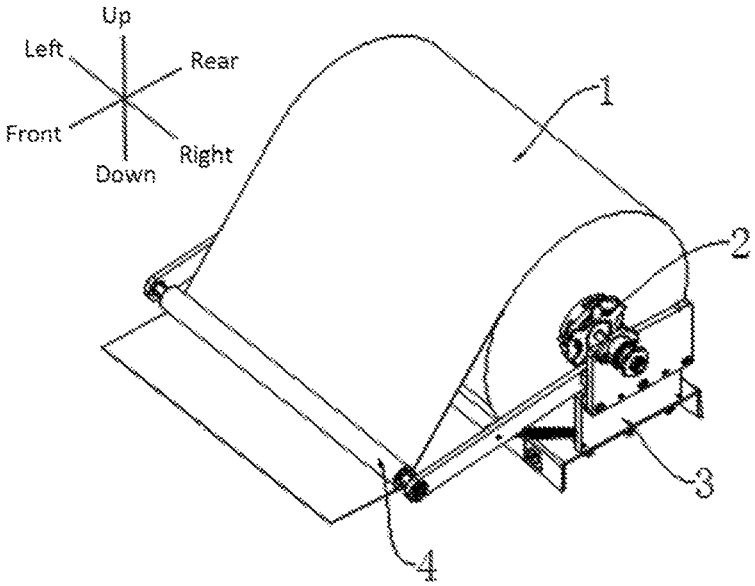
FIG. 2 is a first structural view of a coil feeding device according to an embodiment of the present invention.
Figure 11:
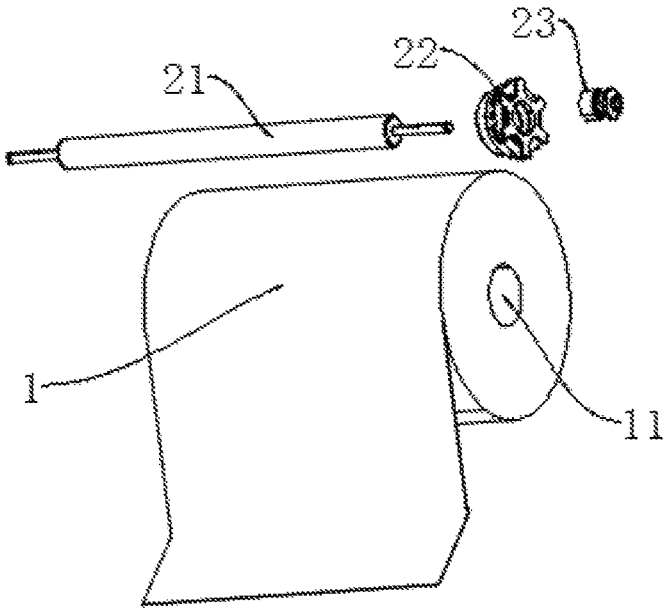
FIG. 11 is a partial exploded view of a roller mechanism according to an embodiment of the present invention.

The embodiment of the present invention provides a coil feeding device, as shown in FIGS. 1, 2 and 11, including a roller mechanism 2, a base mechanism 3 and a compression rod mechanism 4. The roller mechanism 2 is used for carrying a coiled material 1, the coiled material 1 has a shaft hole 11, and the coiled material 1 is fixed on the roller mechanism 2 through the shaft hole 11. The base mechanism 3 is used for supporting the roller mechanism 2, so that the roller mechanism 2 may be suspended to rotate. Further, the base mechanism 3 is detachably mounted on a graphic machine 5 for realizing availability of mounting the coil feeding device on the graphic machine 5 so as to complete the processing of the coiled material 1, and for not affecting other functions of the graphic machine 5 when the coil feeding device is detached from the graphic machine 5. Therefore, the graphic machine 5 may complete the processing of the sheet material. The compression rod mechanism 4 compresses the material on one end of the coiled material 1 on a conveyor belt 51 of the graphic machine 5, so that when the conveyor belt 51 is in operation, a frictional force between the coiled material 1 and the conveyor belt 51 drives the coiled material 1 to rotate and discharge, thereby driving the roller mechanism 2 to rotate.

As shown in FIGS. 2, 3, 11, and 12, the roller mechanism 2 includes a shaft 21 penetrating through the shaft hole 11, and a tension structure 22 is disposed on the shaft 21. The tension structure 22 includes a first sleeve 221 sleeved outside the shaft 21, a second sleeve 222 and a tapered fixing member 223, wherein an outer wall of the first sleeve 221 is connected with the second sleeve 222, and an inner wall thereof is connected with the tapered fixing member 223. An outer wall of the second sleeve 222 is abutted against an inner wall of the shaft hole 11. When the first sleeve 221 and the second sleeve 222 are fixed to each other, the tapered fixing member 223 holds the shaft 21 to achieve mutual fixation of the coiled material 1 and the shaft 21.

Figure 12:
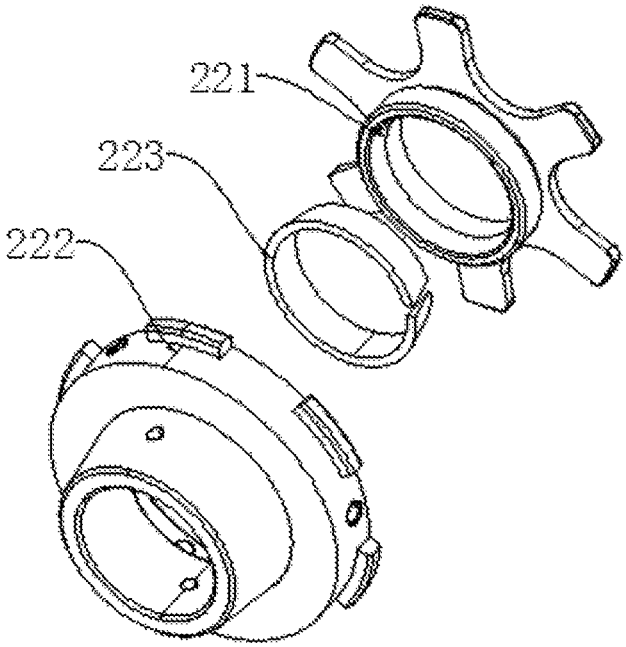
FIG. 12 is a first exploded view of a tension structure according to an embodiment of the present invention.
Figure 17:
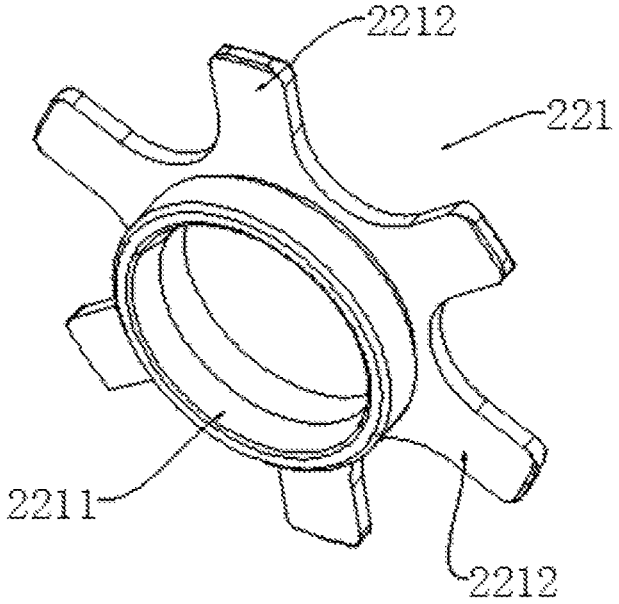
FIG. 17 is a structural view of a first sleeve according to an embodiment of the present invention.

As shown in FIGS. 12 and 17, the first sleeve 221 is in a threaded connection with the second sleeve 222, and the first sleeve 221 has a tapered inner wall 2211 that cooperates with the tapered fixing member 223. The tighter the first sleeve 221 and the second sleeve 222 are screwed to each other, the more the first sleeve 221 compresses the tapered fixing member 223 inward in a radial direction, so that a diameter of the tapered fixing member 223 is small until the tapered fixing member 223 holds the shaft 21. When the first sleeve 221 and the second sleeve 222 are screwed to each other, the tapered fixing member 223 holds the shaft 21, thereby limiting the position of the coiled material 1 in an axial direction of the shaft 21.

The tapered fixing member 223 is an annular tapered fixing member with an open loop, and the diameter of the tapered fixing member 223 is changed by the change of the pitch of the open loop. When the distance of the open loop is zero, that is, the tapered fixing member 223 is a closed loop structure, the diameter of the tapered fixing member 223 is a minimum diameter, and an outer diameter of the shaft 21 must not be smaller than the minimum diameter, otherwise the tension structure 22 may not fix the shaft 21.

Figure 14:
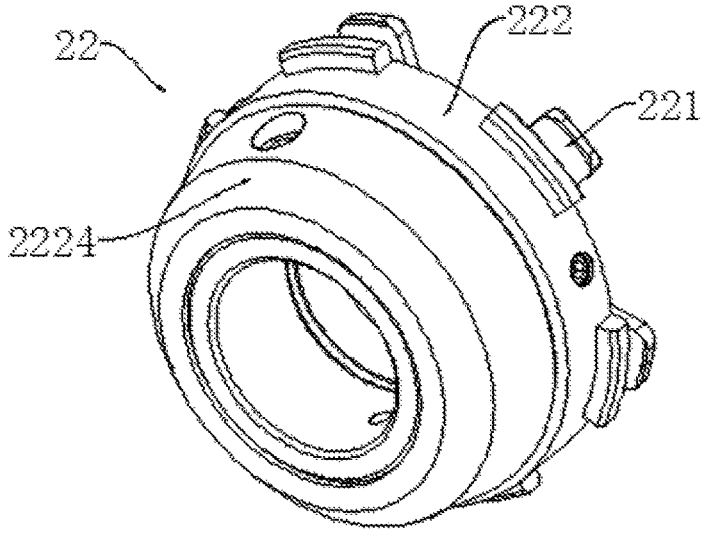
FIG. 14 is a structural view of a tension structure according to an embodiment of the present invention.
Figure 16:
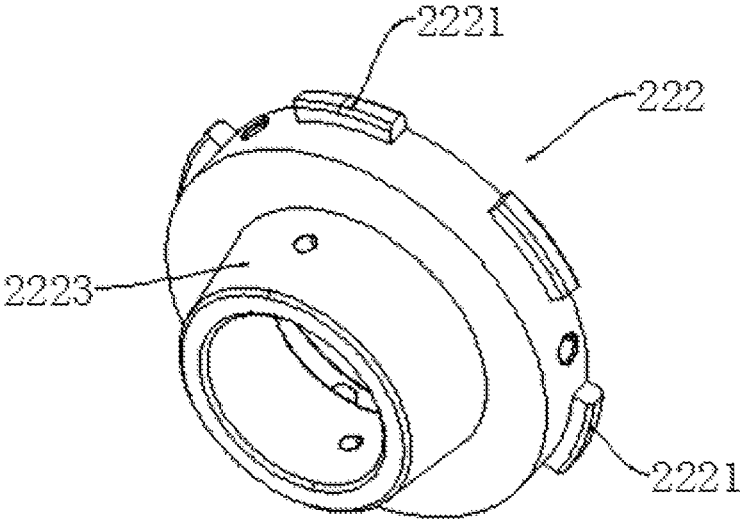
FIG. 16 is a structural view of a second sleeve according to an embodiment of the present invention.

As shown in FIGS. 14, 16 and 17, the first sleeve 221 is uniformly provided with a plurality of first bumps 2212 in a circumferential direction of the outer wall, and the second sleeve 221 is uniformly provided with a plurality of second bumps 2221 in a circumferential direction of the outer wall, so that the fingers of the two hands of a person may act on the first bump 2212 and the second bump 2221, respectively, thereby screwing tightly the first sleeve 221 and the second sleeve 222 to each other.

In this embodiment, by providing the second sleeve 222, the first sleeve 221 and the tapered fixing member 223 that cooperate with each other, the coiled material 1 and the shaft 21 are fastened to each other quickly, thereby improving production efficiency. By providing the detachable base mechanism 3, the coil feeding device may be used as a separate detachable device that may be directly used on the existing graphic machine 5 for the processing of sheet metal. Therefore, in the case that the transformation cost of the graphic machine 5 is low, both the processing of the sheet material and the processing of the coiled material 1 may be realized on the same graphic machine 5, and the processing of the coiled material 1 may be realized, which has strong versatility and is helpful for market promotion.

Figure 13:
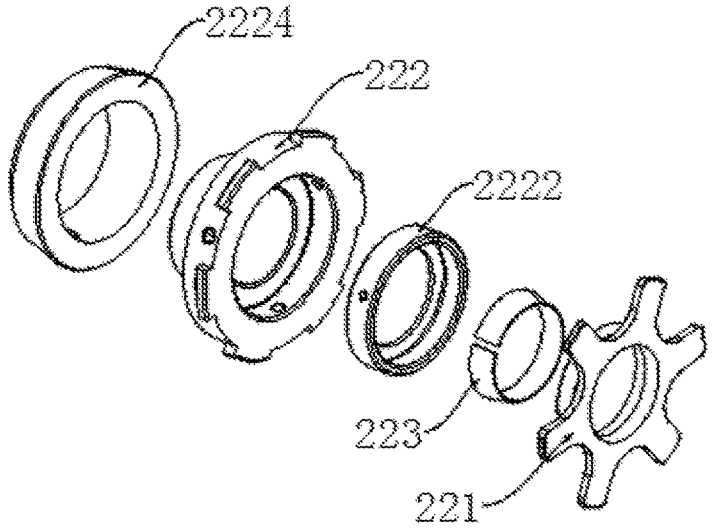
FIG. 13 is a second exploded view of a tension structure according to an embodiment of the present invention.
Figure 15:
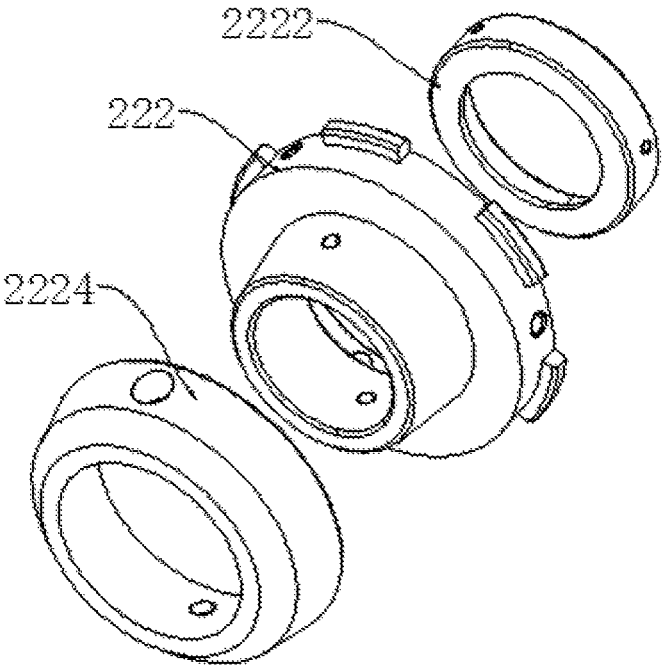
FIG. 15 is an exploded view of a second sleeve according to an embodiment of the present invention.

In addition, since the coiled material 1 has to be replaced, and the first sleeve 221 and the second sleeve 222 have to be frequently assembled and disassembled with each other, the threads on the first sleeve 221 or the second sleeve 222 are extremely fragile. Therefore, in order to reduce the replacement cost of the first sleeve 221 or the second sleeve 222, in this embodiment, as shown in FIGS. 13 and 15, a threaded member 2222 is detachably disposed on the second sleeve 222, and the threaded member 2222 has an outer wall fixedly connected to the second sleeve 222 and an inner wall provided with a thread, wherein the first sleeve 221 is connected to the threaded member 2222 by the thread provided with the outer wall thereof, thereby indirectly achieving mutual fixation of the first sleeve 221 and the second sleeve 222. In addition to this, the threaded member 2222 may also be optionally disposed on the first sleeve 221.

Figure 3:
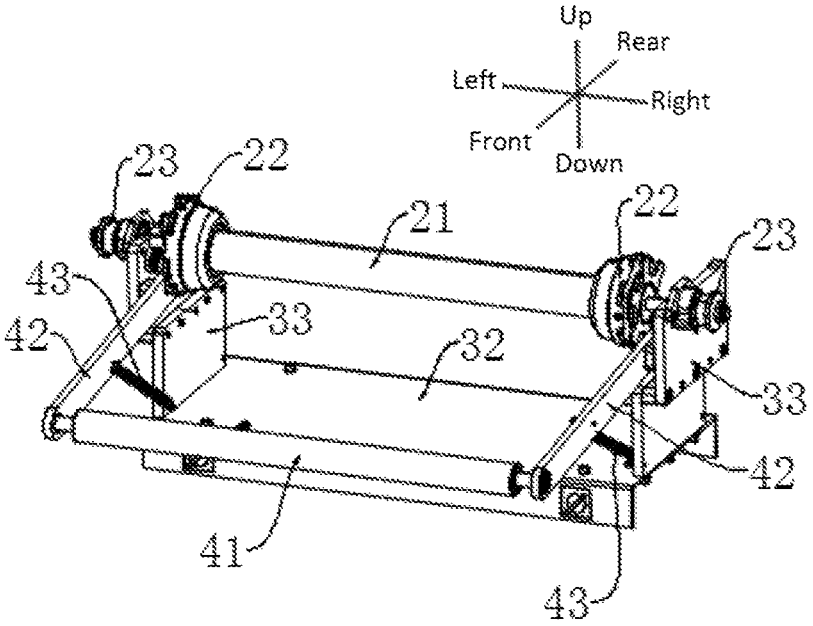
FIG. 3 is a second structural view of a coil feeding device according to an embodiment of the present invention.

As shown in FIG. 3, the number of the tension structure 22 is two, which are respectively disposed at the left and right ends of the shaft 21, so that simultaneous control may be realized at both ends, causing the coiled material 1 to be more firmly fixed on the shaft 21.

Figure 4:
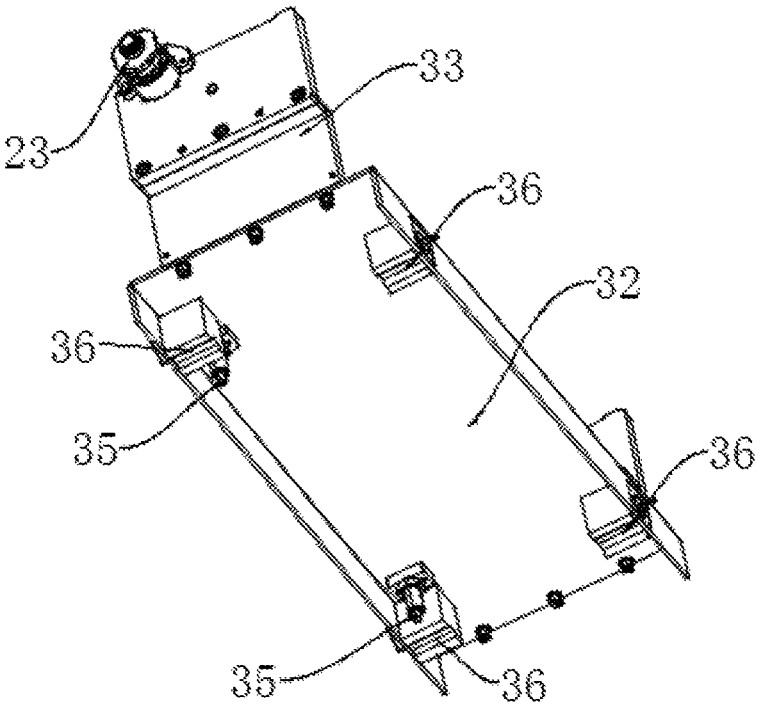
FIG. 4 is a third structural view of a coil feeding device according to an embodiment of the present invention.

As shown in FIG. 4, the base mechanism 3 is detachably fixed to the graphic machine 5 by a magnet 36 of a magnetic seat, and the magnet 36 has a switch for realizing whether the base mechanism 3 is magnetically attracted to the graphic machine 5 by switching the switch. The detachable connection structure is simple, which facilitates the control.

Figure 6:
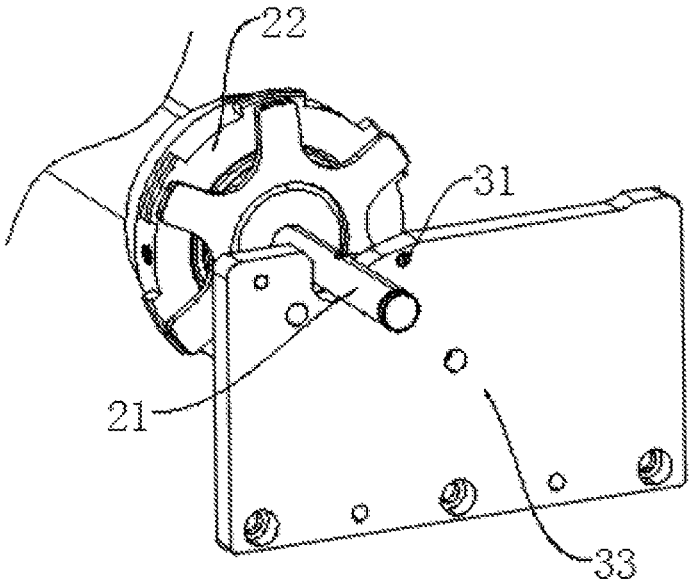
FIG. 6 is a second partial structural view of a coil feeding device according to an embodiment of the present invention.

Preferably, as shown in FIGS. 3 and 6, the base mechanism 3 includes a base 32 and a plurality of support frames 33 fixed to the left and right sides of the base 32, wherein two bearings 34 are provided at an upper end of each of the support frames 33, and the shaft 21 is placed on the bearings 34.

The support frame 33 has a certain height and may support the roller mechanism 2 in a suspension manner, so that the roller mechanism 2 may be fixed above the base 32, so that the roller mechanism 2 can smoothly rotate. Two bearings 34 are mounted on an inner side of the support frame 33, and a groove is disposed at the upper end of the support frame 33, wherein the position of the groove matches with the position of the two bearings 34 and is located between the two bearings 34 so as to prevent the shaft 21 from falling off the support frame 33. The outer wall of the shaft 21 abuts against the two bearings 34, but does not contact the groove, thereby causing reduction of the wear of the shaft 21 and smooth rotation thereof.

Figure 9:
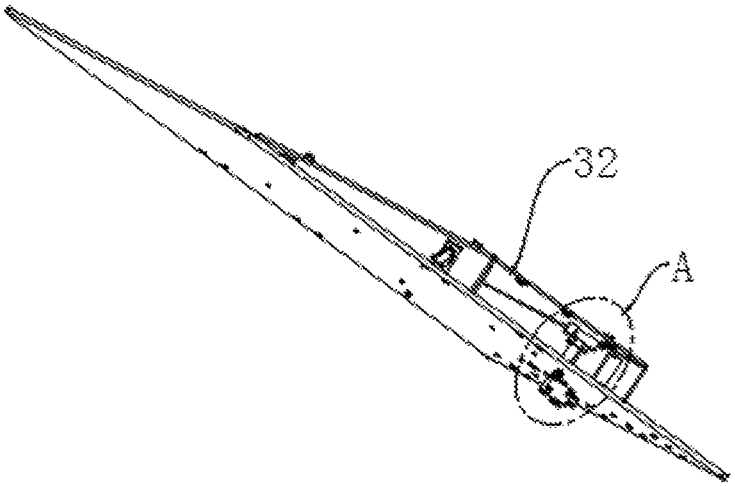
FIG. 9 is a partial structural view of a graphic machine according to an embodiment of the present invention.
Figure 10:
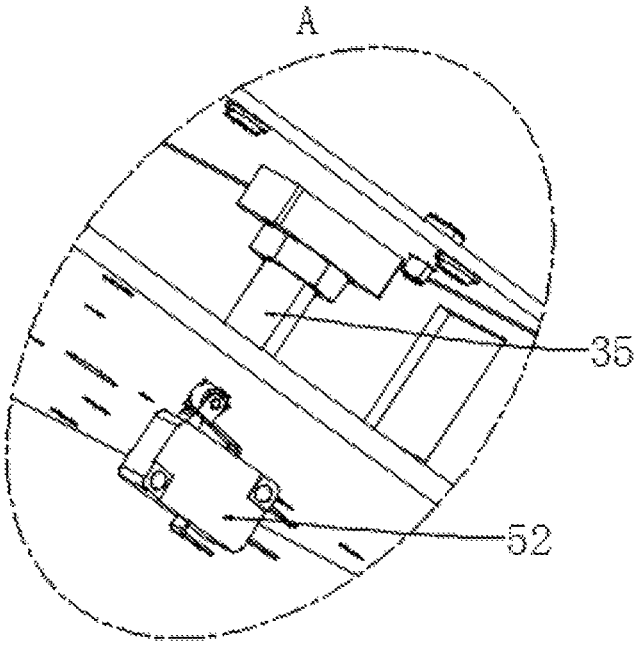
FIG. 10 is an enlarged view of a portion A in FIG. 9.

Preferably, as shown in FIGS. 9 and 10, a switch or sensor 52 for switching the operating mode is disposed on the graphic machine 5, and a pin 35 that cooperates with the switch or sensor 52 is disposed on the base mechanism 3.

The switch or sensor 52 is used to switch the operating mode through ON and OFF controls of the circuit, and the operating mode includes a sheet material processing mode and a coiled material processing mode. When the coil feeding device is mounted on the graphic machine 5, the pin 35 may compress the switch or sensor 52 to switch the operating mode to the coiled material processing mode, so that the processing of the coiled material may be realized on the graphic machine 5; when the coil feeding device is detached from the graphic machine 5, the pin 35 is also disengaged from the switch or sensor 52, causing the switch or sensor 52 to be reset, then the operating mode is switched to the sheet material processing mode, thereby the graphic machine 5 still continuing to process the sheet material.

The pin 35 may not only trigger the switch or the sensor 52, but may also function to mount and position the base 32, so that the base 32 may be properly mounted on the graphic machine 5 for the subsequent processing of coiled material. A bottom plate of the graphic machine 5 for supporting the base 32 is used for carrying the sheet material in the sheet material processing mode, and the coil feeding device is withdrawn from the graphic machine 5, the bottom plate may be automatically reset to the initial position for subsequent processing of the sheet material.

Preferably, as shown in FIGS. 1 and 2, the compression rod mechanism 4 includes a compression rod 41 for compressing the coiled material against the conveyor belt 51, wherein both ends of the compression rod 41 are respectively connected with connection rods 42, the compression rod 41 is hinged to the base mechanism 3 through the connection rods 42, and the connection rods 42 are further connected with a tension spring 43 for tightening the compression rod 41.

The tension spring 43 has a first end connected to the base mechanism 3, and a second end connected to the middle of the compression rod 42, to exert a downward pulling force on the compression rod 41. The compression rod 41 is hinged to the base mechanism 3, so that the compression rod 41 may rotate around the base mechanism 3, and exerting an external force raises the compression rod 41 to be disengaged from the conveyor belt 51 so as to facilitate taking-out of the coiled material 1, or the coiled material 1 is pre-placed on the conveyor belt 51 for facilitating subsequent compression on the coiled material 1 by the compression rod 41.

The compression rod 41 is a rubberized tube having an inner core of iron, wherein the iron is externally injected with rubber. The rubber may increase the friction between the compression rod 41 and the coiled material 1 to prevent slippage, so that the coiled material 1 is caused to follow the conveyor belt 51 to discharge forward when being rolled on the conveyor belt 51, thereby completing the processing of the coiled material 1.

Preferably, as shown in FIGS. 11 and 16, the outer wall of the second sleeve 222 has a tapered surface 2223, and the tapered surface 2223 abuts against the inner wall of the shaft hole 11.

The tapered surface 2223 functions as a guide for facilitating the quick insertion of the second sleeve 222 into the shaft hole 11 of the coiled material 1. A maximum diameter of the tapered surface 2223 is larger than the inner diameter of the shaft hole 11 to ensure the tight adherence between the tapered surface 2223 and the inner wall of the shaft hole 11, thereby realizing the mutual fixation between the second sleeve 222 and the coiled material 1. The minimum diameter of the tapered surface 2223 is smaller than the inner diameter of the shaft hole 11 to facilitate the insertion of the second sleeve 222 into the shaft hole 11.

Preferably, as shown in FIGS. 14, 15 and 16, the outer wall of the second sleeve 222 is detachably connected with an annular tapered member 2224.

Since the specifications of the coiled material 1 are various, the diameter of the inner diameter of the shaft hole 11 of the coiled material 1 is also various. Therefore, the annular tapered member 2224 is detachably provided so that the second sleeve 222 may fix the coiled material 1 having a different inner diameter of the shaft hole 21, enhancing the versatility of the coil feeding device.

Both inner and outer walls of the annular tapered member 2224 are structures of tapered surface, wherein the structure of tapered surface of the inner wall is for matching with the tapered surface 2223 of the second sleeve 222, and the structure of tapered surface of the outer wall is for abutting against the inner wall of the shaft hole 11 of the coiled material 1 and for facilitating the quick insertion of the second sleeve 222 into the shaft hole 11 of the coiled material 1. similarly, the maximum diameter of the annular tapered member 2224 is larger than the inner diameter of the shaft hole 11 to ensure the tight adherence between the annular tapered member 2224 and the inner wall of the shaft hole 11, thereby realizing the mutual fixation between the second sleeve 222 and the coiled material 1. The minimum diameter of the annular tapered member 2224 is smaller than the inner diameter of the shaft hole 11 to facilitate smooth insertion of the second sleeve 222 into the shaft hole 11.

In this embodiment, the annular tapered member 2224 is further disposed on the second sleeve 222, so that the outer diameter of the second sleeve 222 is adjustable for being applied to the inner diameter of the shaft hole 11 of various coiled material 1, which has high versatility.

Preferably, as shown in FIG. 3, the roller mechanism 2 further includes a damper member 23 for preventing the roller mechanism 2 from freely rotating, and the damper member 23 is disposed at both ends of the shaft 21.

The damper member 23 may increase the resistance of the rotation of the shaft 21 for canceling the inertial motion of the roller mechanism 2 when the external force is canceled (i.e., when the conveyor belt 51 stops rotating), so that the shaft 21 may stop rotating immediately, thereby causing the coiled material 1 not to be loose and causing the coiled material 1 to be still in a tension state, so as to realize a neat discharge, to prevent wrinkles, and to ensure the processing pass rate of the coiled material 1.

The damper member 23 includes a screwing shaft, a spring, and a deformation tab, wherein the deformation tab is sleeved outside the shaft 21. When the screwing shaft is screwed inward, the spring is forced to compress the deformation tab inward, and the deformation tab is deformed to then hold the shaft 21, so as to increase the friction between the damper member 23 and the shaft 21, thereby preventing the shaft 21 from being unable to stop rotating in time due to inertia.

Preferably, as shown in FIGS. 2, 5, 7 and 8, the roller mechanism 2 is further provided with a limiting structure 24 for fixing the damper member 23 to the base mechanism 3, wherein the limiting structure 24 includes a limiting member 241 connected to the base mechanism 3, a half-waist groove 2411 is disposed on the limiting member 241, and a limiting surface 231 that cooperates with the half-waist groove 2411 is disposed on the damper member 23.

The limiting surface 231 is a flat surface with the number of two, and the two limiting surfaces 231 are symmetrically disposed on both sides of the outer wall of damper member 23. The half-waist groove 2411 has a semi-circular surface section and a plane section connected at both ends of the semi-circular surface section, and the limiting surface 231 abuts the plane section of the half-waist groove 2411 to restrict the mutual rotation between the damper member 23 and the base mechanism 3, so that the damper member 23 rotates with the shaft 21 when the coiled material 1 rotates, thereby effectively ensuring the limiting effect of the damper member 23 on the shaft 21.

Figure 5:
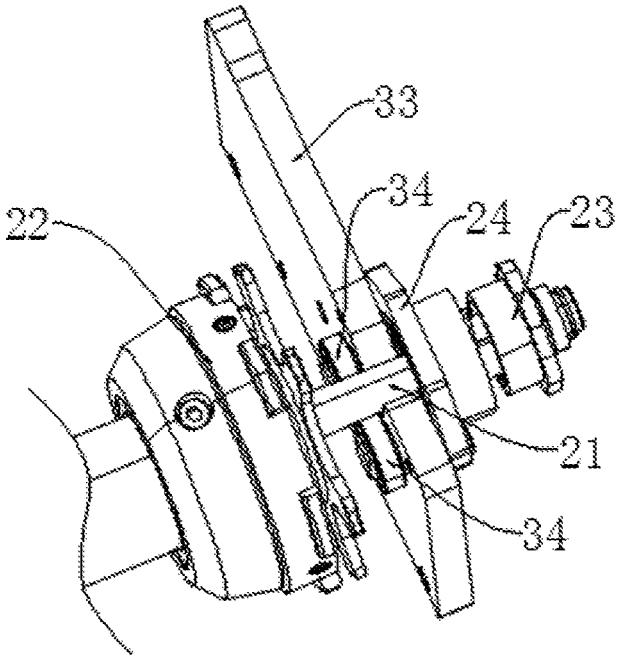
FIG. 5 is a first partial structural view of a coil feeding device according to an embodiment of the present invention.
Figure 7:
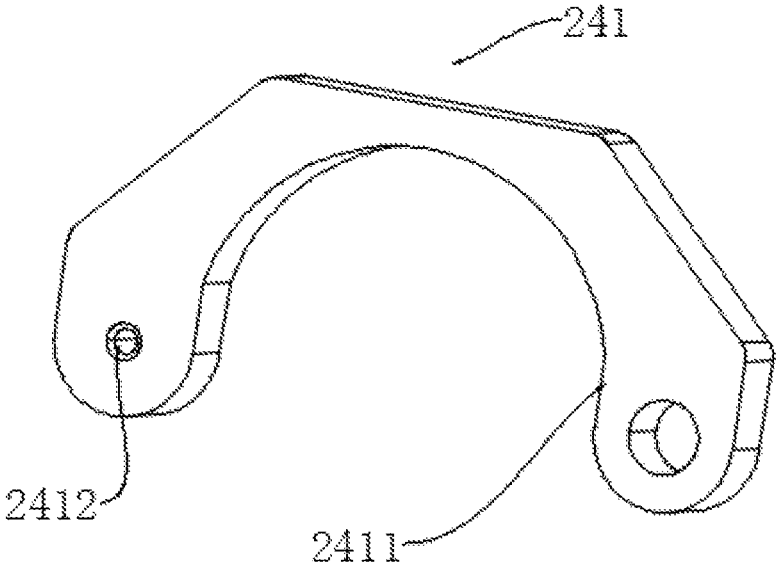
FIG. 7 is a structural view of a limiting member according to an embodiment of the present invention.
Figure 8:
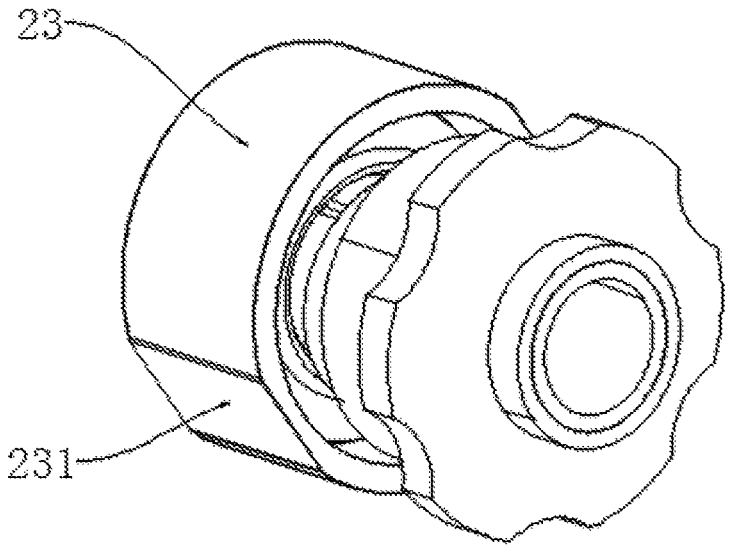
FIG. 8 is a structural view of a damper member according to an embodiment of the present invention.

Preferably, as shown in FIGS. 5 and 7, the limiting member 241 has one end hinged to the base mechanism 3 and the other end provided with a groove 2412, and a bead 31 that cooperates with the groove 2412 is disposed on the base mechanism 3.

When the limiting surface 231 of the damper member 23 is adjusted to a vertical direction, the limiting member 241 may smoothly catch the damper member 23; and when after the limiting member 241 and the damper member 23 are snapped in position with each other, the bead 31 on the base mechanism 3 may just cooperate with the groove 2412 on the limiting member 241, so as to realize the locking of the limiting member 241 and to further effectively restrict the position of the damper member 23, thereby making the coil feeding device to operate normally.

When the roller mechanism 2 is disassembled, only a smaller external force is required to exert on the limiting member 241 for disengaging the bead 31 from the groove 2412, so as to easily release the limiting member 241, thereby making the damper member 23 disengage from the limiting member 241 and then removing the roller mechanism 2 from the base mechanism 3 to complete the detaching operation of the roller mechanism 2.

In this embodiment, by providing a hinged structure for the limiting member 241 and a structure in which the bead 31 cooperates with the groove 2412, the roller mechanism 2 is facilitated to be mounted quickly to the base mechanism 3, or the roller mechanism 2 to be detached from the roller mechanism 3, thereby improving the processing efficiency of the coiled material 1.

A graphic machine comprising the above coil feeding device is provided in another embodiment of the present invention.

In this embodiment, by providing the second sleeve 222, the first sleeve 221 and the tapered fixing member 223 that cooperate with each other, the coiled material 1 and the shaft 21 are fastened to each other quickly, thereby improving production efficiency. By providing the detachable base mechanism 3, the coil feeding device may be used as a separate detachable device that may be directly used on the existing graphic machine 5 for the processing of sheet metal. Therefore, in the case that the transformation cost of the graphic machine 5 is low, both the processing of the sheet material and the processing of coiled material may be realized on the same graphic machine 5, which has strong versatility and is helpful for market promotion.

Although the present invention is disclosed as above, the scope of protection of the present invention is not limited thereto. A person skilled in the art can make various changes and modifications without departing from the spirit and scope of the present invention, and such changes and modifications will fall within the scope of the present invention.

What is claimed is:

1. A coil feeding device, comprising:

a roller mechanism, used to carry a coiled material having a shaft hole, wherein the roller mechanism comprises a shaft penetrating through the shaft hole, a tension structure is disposed on the shaft, and the tension structure comprises:

a first sleeve, sleeved outside the shaft;

a second sleeve, wherein an outer wall of the second sleeve is abutted against an inner wall of the shaft hole; and a tapered fixing member;

wherein an outer wall of the first sleeve is connected to the second sleeve, and an inner wall of the first sleeve is connected to the tapered fixing member;

wherein when the first sleeve and the second sleeve are fixed to each other, the tapered fixing member holds the shaft to achieve mutual fixation of the coiled material and the shaft;

a base mechanism, used to support the roller mechanism, wherein the base mechanism is detachably mounted on a graphic machine;

a compression rod mechanism, used to drive a rotation of the roller mechanism, wherein the compression rod mechanism is used in concert with a conveyor belt of the graphic machine.

2. The coil feeding device according to claim 1, wherein the base mechanism further comprises:

a base;

two support frames, fixed to left and right sides of the base; and a plurality of bearings, wherein two bearings are disposed at an upper end of each of the support frames, and the shaft is placed on the plurality of bearings.

3. The coil feeding device according to claim 1, wherein the compression rod mechanism further comprises:

a compression rod, used to compress the coiled material against the conveyor belt;

two connection rods, wherein the two connection rods are respectively connected to both ends of the compression rod, and the compression rod is hinged to the base mechanism through the two connection rods; and a tension spring, connected between the two connection rods, and used to tighten the two compression rods.

4. The coil feeding device according to claim 1, wherein the outer wall of the second sleeve further comprises a tapered surface, and the tapered surface is used to abut against the inner wall of the shaft hole.

5. The coil feeding device according to claim 1, wherein the outer wall of the second sleeve is detachably connected with an annular tapered member.

6. The coil feeding device according to claim 1, wherein the roller mechanism further comprises:

a damper member, disposed at both ends of the shaft, and used to prevent the roller mechanism from freely rotating.

7. The coil feeding device according to claim 6, wherein the roller mechanism further comprises:

a limiting structure, used to fix the damper member to the base mechanism, further comprising:

a limiting member, connected to the base mechanism;

wherein a half-waist groove is disposed on the limiting member, and a limiting surface that cooperates with the half-waist groove is disposed on the damper member.

8. The coil feeding device according to claim 7, wherein the limiting member has a first end hinged to the base mechanism and a second end provided with a groove;

and a bead that cooperates with the groove is disposed in the base mechanism.

9. A graphic machine, comprising:

a coil feeding device, comprising:

a roller mechanism for carrying a coiled material having a shaft hole, wherein the roller mechanism comprises a shaft penetrating through the shaft hole, a tension structure is disposed on the shaft, and the tension structure comprises:

a first sleeve, sleeved outside the shaft;

a second sleeve, wherein an outer wall of the second sleeve is abutted against an inner wall of the shaft hole; and a tapered fixing member;

wherein an outer wall of the first sleeve is connected to the second sleeve, and an inner wall of the first sleeve is connected to the tapered fixing member;

wherein when the first sleeve and the second sleeve are fixed to each other, the tapered fixing member holds the shaft to achieve mutual fixation of the coiled material and the shaft;

a base mechanism, used to support the roller mechanism, wherein the base mechanism is detachably mounted on the graphic machine; and a compression rod mechanism, used to drive a rotation of the roller mechanism, wherein the compression rod mechanism is used in concert with a conveyor belt of the graphic machine.

10. The graphic machine according to claim 9, further comprising:

a switch or sensor, used to switch an operating mode of the graphic machine;

wherein a pin, that cooperates with the switch or sensor, is disposed on the base mechanism.

11. The graphic machine according to claim 9, wherein the base mechanism further comprises:

a base;

two support frames, fixed to left and right sides of the base; and a plurality of bearings, wherein two bearings are disposed at an upper end of each of the support frames, and the shaft is placed on the plurality of bearings.

12. The graphic machine according to claim 9, wherein the compression rod mechanism further comprises:

a compression rod, used to compress the coiled material against the conveyor belt;

two connection rods, wherein the two connection rods are respectively connected to both ends of the compression rod, and the compression rod is hinged to the base mechanism through the two connection rods; and a tension spring, connected between the two connection rods, and used to tighten the two compression rods.

13. The graphic machine according to claim 9, wherein the outer wall of the second sleeve further comprises a tapered surface, and the tapered surface is used to abut against the inner wall of the shaft hole.

14. The graphic machine according to claim 9, wherein the outer wall of the second sleeve is detachably connected with an annular tapered member.

15. The graphic machine according to claim 9, wherein the roller mechanism further comprises:

a damper member, disposed at both ends of the shaft, and used to prevent the roller mechanism from freely rotating.

16. The graphic machine according to claim 15, wherein the roller mechanism further comprises:

a limiting structure, used to fix the damper member to the base mechanism, further comprising:

a limiting member, connected to the base mechanism;

wherein a half-waist groove is disposed on the limiting member, and a limiting surface that cooperates with the half-waist groove is disposed on the damper member.

17. The graphic machine according to claim 16, wherein the limiting member has a first end hinged to the base mechanism and a second end provided with a groove; and a bead that cooperates with the groove is disposed in the base mechanism.

* * * * *